US007727583B2

(12) United States Patent
Dieleman et al.

(10) Patent No.: US 7,727,583 B2
(45) Date of Patent: Jun. 1, 2010

(54) METHOD FOR THE PRODUCTION OF STRUCTURED SURFACES

(75) Inventors: Cedric Dieleman, Scheibenhard (FR); Harald Keller, Ludwigshafen (DE); Wolfgang Schrepp, Heidelberg (DE); Thomas Frechen, Heidelberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 506 days.

(21) Appl. No.: 11/568,858

(22) PCT Filed: May 17, 2005

(86) PCT No.: PCT/EP2005/005348

§ 371 (c)(1),
(2), (4) Date: Nov. 9, 2006

(87) PCT Pub. No.: WO2005/113885

PCT Pub. Date: Dec. 1, 2005

(65) Prior Publication Data

US 2008/0014432 A1 Jan. 17, 2008

(30) Foreign Application Priority Data

May 19, 2004 (DE) ..... 10 2004 025 368

(51) Int. Cl.
*B05D 1/36* (2006.01)
*B32B 5/16* (2006.01)

(52) U.S. Cl. ..... 427/201; 428/323; 427/202; 427/412

(58) Field of Classification Search ..... 427/201
See application file for complete search history.

(56) References Cited

U.S. PATENT DOCUMENTS

| | | | | |
|---|---|---|---|---|
| 3,354,022 | A | 11/1967 | Dettre et al. | |
| 5,277,978 | A * | 1/1994 | Feustel et al. | 428/402 |
| 6,017,998 | A * | 1/2000 | Duan et al. | 524/591 |
| 6,105,500 | A * | 8/2000 | Bhambra et al. | 101/455 |
| 2004/0023824 | A1 * | 2/2004 | Zuechner et al. | 510/276 |
| 2004/0171515 | A1 * | 9/2004 | Hamers et al. | 510/504 |
| 2004/0237833 | A1 * | 12/2004 | Sepeur et al. | 106/13 |
| 2005/0118911 | A1 * | 6/2005 | Oles et al. | 442/118 |
| 2006/0174418 | A1 | 8/2006 | Keller et al. | |

FOREIGN PATENT DOCUMENTS

| | | |
|---|---|---|
| CN | 1639296 | 7/2005 |
| DE | 101 16 200 | 10/2002 |
| EP | 0 761 696 | 3/1997 |
| EP | 1 171 529 | 1/2002 |
| JP | 08-259851 | 10/1996 |
| JP | 2001-303434 | 10/2001 |
| JP | 2003-201672 | 7/2003 |
| WO | 96 04123 | 2/1996 |
| WO | 01 83662 | 11/2001 |
| WO | 02 31080 | 4/2002 |
| WO | 02 103105 | 12/2002 |
| WO | 03 066710 | 8/2003 |

OTHER PUBLICATIONS

U.S. Appl. No. 11/569,330, filed Nov. 17, 2006, Dieleman.

* cited by examiner

*Primary Examiner*—Frederick J Parker
(74) *Attorney, Agent, or Firm*—Oblon, Spivak, McClelland, Maier & Neustadt, L.L.P.

(57) ABSTRACT

Provided is a process for producing a structured surface possessing a high level of hydrophilicity, wherein the process involves: coating a surface with a mixture to produce the structured surface, wherein the mixture includes: particles (a) having a number average particle diameter of from 0.1 μm to 10 μm; and particles (b) having a number average particle diameter of from 5 nm to 0.5 μm and a 20° C. surface energy of greater than or equal to 80 mN/in, and wherein the mixture exhibits a bimodal particle diameter distribution of particles (a) and particles (b). The mixture may optionally include an aqueous liquor, an emulsifier, a binder, an adhesion promoter, a thickener, and/or a pigment. Also provided is a structured surface produced by the process. A non-limiting example of the structured surface produced by the process is a structured textile surface.

19 Claims, No Drawings

METHOD FOR THE PRODUCTION OF STRUCTURED SURFACES

CROSS-REFERENCE TO RELATED APPLICATIONS

The present application is a 35 U.S.C. §371 National Stage patent application of International patent application PCT/EP2005/005348, filed on May 17, 2005, which claims priority to German patent application DE 102004025368.4, filed on May 19, 2004.

FIELD OF THE INVENTION

The present invention relates to a process for producing structured surfaces possessing a high level of hydrophilicity, which comprises coating the surfaces with (a) particles having a number average diameter in the range from 0.1 to 10 μm and (b) particles having a number average diameter in the range from 5 nm to 0.5 μm and a 20° C. surface energy of not less than 100 mN/m.

The present invention further relates to su faces obtainable by the process of the present invention.

DISCUSSION OF THE BACKGROUND

It is generally desirable to modify surfaces such that they have little tendency if any to become soiled. Such surfaces look esthetic for a prolonged period, remain free of bacterial or fungal growth and, if or when they are cleaned, are particularly easy to clean.

State of the art methods for producing surfaces possessing a low tendency to become soiled frequently utilize the Lotus Effect®, for example WO 96/04123 and EP-B 1 171 529. To endow a surface with a Lotus Effect, one may for example provide surfaces in the manner of the lotus plant with a microrough surface, for example with elevations and depressions in such dimensions that the elevations are from 5 to 200 μm spaced apart and from 5 to 100 μm high and the elevations at least consist of, for example, hydrophobic polymers and are not detachable by water or water with detergents. Thus endowed surfaces are observed to have a large contact angle with water, for example 157°, see for Example 9 of U.S. Pat. No. 3,354,022. Soil particles have low adhesion to thus endowed surfaces and are easily removed by rinsing off with water.

However, textile surfaces endowed with Lotus Effect are disadvantageous in that they are not pervious to perspiration. Yet perspiration perviousness is desirable in many cases for garments in particular.

It is also desirable that diapers retain urine and do not occasion urine drop formation. This holds for example for diapers produced by use of polypropylene and of superabsorbents.

Another method for endowing surfaces to be soil repellent consists in rendering them very hydrophilic. Water then forms a film and easily detaches soil particles, see for example WO 03/66710.

WO 01/83662 discloses that certain particles from 5 to 500 nm in size can be used to treat textiles in order that they may be soil repellent for a certain period, generally up to 4 washing or cleaning cycles (last paragraph on page 2). Such short finish lives are undesirable in some applications, however.

DE-A 101 16 200 discloses that surfaces can be coated with very finely divided inorganic particles, surface modifiers and if appropriate a surfactant and that the surfaces subsequently possess antimisting properties. Such coatings, however, do not survive a wash cycle without being impaired.

SUMMARY OF THE INVENTION

The present invention accordingly has for its object to provide a process whereby surfaces can be treated that they may repel soil effectively and possess good durability. The present invention further has for its object to provide coated surfaces possessing a high level of hydrophilicity. The present invention finally has for its object to provide uses for coated surfaces.

DETAILED DESCRIPTION OF THE INVENTION

We have found that this object is achieved by the process defined at the beginning.

Surfaces are said herein to possess a high level of hydrophilicity when their contact angle with water is not measurable. On surfaces according to the present invention, water does not form droplets, but spreads to form a film.

Structured surfaces according to the present invention are produced from entities having at least one surface, such entities hereinafter also being referred to as substrates, which can consist of a multiplicity of materials, for example concrete, brick solidified mortar, wood, metal, ceramic, paper, board, glass, plastics materials such as for example polystyrene, polyethylene, polypropylene, polyamide, polyester, leather, leather imitations and especially textile.

Textile substrates for the purposes of the present invention are textile fibers, textile intermediate and end products and finished articles manufactured therefrom which, as well as textiles for the apparel industry, also include for example carpets and other home textiles and also textile structures for industrial purposes. These include unshaped structures such as for example staples, linear structures such as twine, filaments, yarns, lines, strings, laces, braids, cordage and threads and also three-dimensional structures such as for example felts, wovens, nonwovens and weddings. The textiles can be of natural origin, for example cotton, wool or flax, or synthetic, for example polyamide, polyester, modified polyester, polyester blend fabric, polyamide blend fabric, polyacrylonitrile, triacetate, acetate, polycarbonate, polypropylene, polyvinyl chloride polyester microfibers and glass fiber fabric.

The present invention comprises structuring surfaces, by coating them with (a) particles having a number average diameter in the range from 0.1 to 10 μm, preferably in the range from 0.2 to 5 μm and more preferably up to 1 μm, and (b) particles having a number average diameter in the range from 5 nm to 10 μm, preferably in the range from 10 nm to 400 nm and more preferably in the range from 20 nm to 300 nm, and a 20° C. surface energy of not less than 80 mN/m.

The particle diameter may be measured by commonly employed methods such as transmission electron microscopy for example.

Particles (a) may be materials which can be selectively hydrophilic or hydrophobic. Particles (b) have a surface energy of not less than 100 mN/m to about 1000 mN/m, determined by contact angle determinations for example.

Hydrophobic in connection with hydrophobic materials refers in the context of the present invention to materials having a surface energy in the range from 10 mN/m to 70 mN/m and preferably in the range from 20 mN/m to 60 mN/m, ascertained by contact angle determinations for example.

Hydrophilic and hydrophobic materials may be selected from inorganic materials and organic polymers and copolymers.

As hydrophobic materials (a) there may be mentioned hydrophobic organic polymers, for example polyethylene, polypropylene, polyisobutylene and polystyrene and also copolymers thereof with each or with one or more further olefins such as for example styrene, methyl acrylate, ethyl acrylate, methyl methacrylate, butyl acrylate, butyl methacrylate, 2-ethylhexyl acrylate, 2-ethylhexyl methacrylate, maleic anhydride or N-methylmaleimide. A preferred polyethylene or polypropylene is described in EP-A 0 761 696 for example.

Hydrophobic organic polymers for the purposes of the present invention also include room temperature solid silicones.

The weight average molecular weight $M_w$ of hydrophobic organic polymer used in the present invention as a hydrophobic material (a) can be in the range from 1000 to 10 000 000 g/mol and preferably in the range from 2500 to 5 000 000 g/mol, ascertained by at least one of the following methods: light scattering, gel permeation chromatography (GPC), viscometry. For a polymer from the group of the polyolefins, for example polyethylene, polypropylene or polyisobutene and also copolymers of ethylene with propylene, butylene or 1-hexene, the molecular weight $M_w$ is advantageously in the range from 30 000 to 5 000 000 g/mol. Hydrophobic organic polymers can for example have waxy properties or else be thermoplastic.

The breadth of the molecular weight distribution of hydrophobic organic polymer used in the present invention as a hydrophobic material (a) is as such not critical and can be in the range from 1.1 to 20. It is typically in the range from 2 to 10.

As hydrophobic inorganic materials (a) there may be mentioned hydrophobicized inorganic materials, especially solid inorganic oxides, carbonates, carbides, phosphates, silicates or sulfates of groups 3 to 14 of the periodic table, for example calcium oxide, silicon dioxide or aluminum oxide, calcium carbonate, calcium sulfate or calcium silicate, of which aluminum oxide and silicon dioxide are preferred. Particular preference is given to silicon dioxide in its silica gel form. Very particular preference is given to pyrogenic silica gels. Solid inorganic oxides and silicate can be hydrophobicized thermally by heating to 400-800° C. or preferably by physisorbed or chemisorbed organic or metal-organic compounds. To this end, particles which have not yet entered the coating step are reacted for example with organometallic compounds containing at least one functional group, examples being alkyllithium compounds such as methyllithium, n-butyllithium or n-hexyllithium; or silanes such as for example hexamethyldisilazane, octyltrimethoxysilane and especially halogenated silanes such as trimethylchlorosilane or dichlorodimethylsilane.

As hydrophilic inorganic materials (a) there can be used in particular solid inorganic oxides, carbonates, phosphates, silicates or sulfates of groups 3 to 14 of the periodic table which have not been hydrophobicized, examples being calcium oxide, silicon oxide or aluminum oxide, calcium carbonate, calcium sulfate or calcium silicate, of which aluminum oxide and silicon dioxide are preferred, also quartz and boehmite, colloidal silica gel and diatomaceous earth. Preference is given to pyrogenic silica, pyrogenic titania and pyrogenic alumina.

Particles (b) can be composed for example of hydrophilic inorganic materials and of hydrophilic polymers. As hydrophilic inorganic materials (b) there are to be mentioned solid inorganic oxides, carbonates, phosphates, silicates or sulfates of groups 3 to 14 of the periodic table which have not been hydrophobicized, examples being calcium oxide, silicon dioxide or aluminum oxide, calcium carbonate, calcium sulfate or calcium silicate, of which aluminum oxide and silicon dioxide are preferred, also quartz and boehmite, colloidal silica gel and diatomaceous earth. Preference is given to pyrogenic silica, pyrogenic titania and pyrogenic alumina.

In one embodiment of the present invention particles (a) and particles (b) differ not in their composition but only in their average particle diameter. The particle diameter distribution of a mixture of particles (a) and (b) is then bimodal.

In another embodiment of the present invention particles (a) and particles (b) differ not just in their average particle diameter but also in their composition.

In one embodiment of the present invention (a) or (b) is selected from aforementioned organic polymers and copolymers.

In one embodiment of the present invention coating is effected with particles (a) and (b) in a weight ratio in the range from 1:99 to 99:1, preferably in the range from 1:9 to 9:1 and more preferably in the range from 3:7 to 7:3.

In one embodiment of the process according to the present invention particles (a) and (b) are each used in an aqueous liquor, preferably in a conjoint aqueous liquor.

An aqueous liquor refers in what follows not just to liquors having water as sole medium that is liquid at room temperature, but also to such liquors as comprise a mixture of water and one or more nonaqueous room temperature liquid media, for example alcohols, e.g., ethanol, isopropanol, butanol, tert-butanol, 3-octanol, 1-decanol, 2-decanol, 2-dodecanol, 2-hexadecanol, ketones, e.g., acetone, methyl ethyl ketone, methyl isobutyl ketone, diethyl ketone, ethers, e.g., THF, di-n-propyl ether, dioxanes such as 1,4-dioxane.

In one embodiment of the present invention the process of the present invention is carried out using one or more aqueous liquors which each comprise from 0.1 to 500 g/l of particles, preferably from 1 to 250 g/l and more preferably from 10 to 100 g/l of particles, all reckoned on the sum total of particles (a) and (b).

One embodiment of the present invention comprises applying from 0.1 to 30 g of particles, i.e., sum total of (a) and (b), per $m^2$ of surface area to be coated, preferably from 0.5 to 20 g $g/m^2$ of particles and more preferably from 1 to 15 $g/m^2$.

In one embodiment of the present invention the application of par ices is followed by a fixing step, which can be thermal, for example at 80 to 250° C. and preferably from 100 to 210° C. Preferred durations range from 10 to 24 minutes. Other versions of the fixing step are the addition of a crosslinker, especially when binders (c) are employed, or fixing with the aid of actinic radiation.

In one embodiment of the present invention the process of the present invention is carried out using one or more aqueous liquors of which at least one comprises one or more emulsifiers selected for example from the group of ionic and nonionic emulsifiers.

Useful nonionic emulsifiers include for example ethoxylated mono-, di- and trialkylphenols (degree of ethoxylation: 3-50, alkyl radical: $C_4$-$C_{12}$) and also ethoxylated fatty alcohols (degree of ethoxylation: 3-80; alkyl radical: $C_8$-$C_{36}$). Examples thereof are the Lutensol® grades from BASF Aktiengesellschaft or the Triton® grades from Union Carbide. Alcohols to be ethoxylated can be of synthetic or natural origin, for example coco fatty alcohol, palm kernel fatty alcohol, tallow fatty alcohol and oleyl alcohol.

Useful anionic emulsifiers include for example alkali metal and ammonium salts of alkyl sulfates (alkyl radical: $C_8$-$C_{12}$), of sulfuric monoesters of ethoxylated alkanols (degree of ethoxylation: 4-30, alkyl radical: $C_{12}$-$C_{18}$) and of ethoxylated alkylphenols (degree of ethoxylation: 3-50, alkyl radical: $C_4$-$C_{12}$), of alkylsulfonic acids (alkyl radical; $C_{12}$-$C_{18}$) of $C_1$-$C_{10}$-mono- or dialkyl esters of sulfosuccinic acid and of alkylarylsulfonic acids (alkyl radical: $C_9$-$C_{18}$).

Useful cationic emulsifiers are generally $C_6$-$C_{18}$-alkyl-, $C_6$-$C_{18}$-aralkyl- or heterocyclyl-containing primary, secondary, tertiary or quaternary ammonium salts, alkanol-ammonium salts, pyridinium salts, imidazolinium salts, oxazolinium salts, morpholinium salts, thiazolinium salts and also salts of amine oxides, quinolinium salts, isoquinolinium salts, tropylium salts, sulfonium salts and phosphonium salts. Examples which may be mentioned are dodecylammonium acetate or the corresponding hydrochloride, the chlorides or acetates of the various 2-(N,N,N-trimethylammonium)-ethyl paraffinic acid esters, N-cetylpyridinium chloride, N-laurylpyridinium sulfate and also N-cetyl-N,N,N-trimethylammonium bromide, N-dodecyl-N,N,N-trimethylammonium bromide, N,N-distearyl-N,N-dimethylammonium chloride and also the Gemini surfactant N,N'-(lauryldlmethyl)ethylenediamine dibromide. Numerous further examples may be found in H. Stache, *Tensid-Tashenbuch*, Carl-Hanser-Veriag, Munich, Vienna, 1981 and in McCutcheon's, *Emulsifiers & Detergents*, MC Publishing Company, Glen Rock, 1989. Useful cationic emulsifiers further include mono to decaalkoxylated and preferably mono- to tetraethoxylated $C_{10}$-$C_{20}$-alkylamines.

Very particularly suitable emulsifiers include for example copolymers of ethylene and at least one α,β-unsaturated mono- or dicarboxylic acid or at least one anhydride of an α,β-unsaturated mono- or dicarboxylic acid, for example acrylic acid, methacrylic acid, crotonic acid, maleic acid, fumaric acid, methylenemalonic acid, maleic anhydride, itaconic anhydride. The carboxyl groups can be partly or preferably wholly neutralized, for example with alkali metal ions, alkaline earth metal ions, ammonium or amines, for example amines such as triethylamine, diethylamine, ethylamine, trimethylamine, dimethylamine, methylamine, ethyldiisopropylamine, ethanolamine, diethanolamine, triethanolamine, N-methyldiethanolamine, N-(n-butyl diethanolamine or N,N-dimethyl-ethanolamine.

The fraction of emulsifier can be varied within wide limits and can be in the range from 0.1 to 200 g/l of aqueous liquor, preferably from 0.2 to 100 g/l and more preferably from 1 to 50 g/l.

The process of the present invention is preferably carried out by treating substrate with (a) and (b), for example in aqueous liquor. Suitable techniques are spraying, dipping, roll application, foam application and doctor coating and especially application using one or more pad-mangles.

The process of the present invention can be carried out by treating substrates and especially textile substrates with at least one aqueous liquor. It is possible to carry out plural treatment steps with identical or different liquors.

In one embodiment of the present invention the process of the present invention comprises treating substrates and especially textile substrates first with a liquor which comprises (b) and if appropriate at least one emulsifier and subsequently with a new liquor which comprises (a) and if appropriate at least one emulsifier.

In one embodiment of the present invention the process of the present invention comprises treating substrates and especially textile substrates first with a liquor which comprises (a) and if appropriate at least one emulsifier and subsequently with a new liquor which comprises (b) and if appropriate at least one emulsifier. The temperature for carrying out the process of the present invention is as such not critical. The liquor temperature can be in the range from 10 to 100° C. and preferably in the range from 15 to 60° C.

The process of the present invention can be carried out in machines commonly used for finishing substrates and especially textiles, for example pad-mangles. Preference is given to vertical textile feed pad-mangles, where the essential element is two rollers in press contact with each other, through which the textile is led. The liquor is filled in above the rollers and wets the textile. The pressure causes the textile to be squeezed off and ensures a constant add-on.

One embodiment of the present invention utilizes a pad-mangle operated with a textile feed in the range from 1 to 40 m/min and preferably up to 30 m/min.

Liquor pickup can be chosen such that the process of the present invention results in a liquor pickup in the range from 25% by weight to 85% by weight and preferably in the range from 40% to 70% by weight.

The treated substrate and especially textile after the treatment according to the present invention can be dried by customary methods or to be more precise methods customary in the textile industry.

The treatment according to the present invention can be followed by a heat treatment, which can be operated continuously or batchwise. The duration of the heat treatment can be chosen within wide limits. The heat treatment can typically be carried out for from about 10 seconds to about 30 minutes, especially from 30 seconds to 5 minutes. The heat treatment is carried out by heating to temperatures of up to 180° C., preferably up to 150° C. It is of course necessary to adapt the temperature of the heat treatment to the sensitivity of the fabric.

An example of a suitable method of heat treatment is hot air drying.

If it is desired to coat textile material, one embodiment of the present invention comprises providing the textile material with a bonding layer prior to the actual coating. The bonding layer can be provided using one or more so-called primers. The application of primer is preferable when synthetic fibers are to be finished.

In one embodiment of the present invention, the bonding layer applied to the textile material to be treated can be for example one or more polymers, in which case the polymer synthesis can also be carried out on the textile material. Particularly useful polymers have crosslinked or crosslinking-capable groups, for example natural or synthetic polymers having free hydroxyl groups, carbonyl groups, primary or secondary amino groups or thiol groups. Examples of very useful polymers are lignin, polysaccharides, polyvinyl alcohol and polyethyleneimine. Crosslinking can be accomplished for example by subsequent reaction with for example isocyanates, dimethylolurea or N,N-dimethylol-4,5-dihydroxyethyleneurea (DMDHEU). Other particularly preferred crosslinkers are melamine-formaldehyde resins, which can have been etherified with methanol n-butanol or ethylene glycol.

In another embodiment, when polyesters or polyamides are to be treated, from 0.01% to 1% by weight and preferably from 0.1 to 0.5% by weight of the textile is saponified by partial saponification with strong alkalis such as aqueous sodium hydroxide solution or potassium hydroxide solution.

In one embodiment of the present invention at least one aqueous liquor used in the process of the present invention comprises at least one binder (c).

Any binder customary in coating technology is in principle suitable for use as binder (c).

Self-crosslinking binders, so called, are especially suitable for textile substrates. Self-crosslinking binders for the purposes of the present invention are polymers, preferably in the form of aqueous polymeric dispersions, which enter intra- and intermolecular crosslinking reactions in the course of drying the coating produced according to the present invention. Crosslinking reactions are effected as a result of the polymers used as binders either having different functional groups, which react with each other to form ionic or covalent bonds, or having added to them one or more crosslinker which can be for example low in molecular weight, i.e., its molecular weight $M_w$ can be for example 500 g/mol or less. The crosslinker or crosslinkers have at least two functional groups per molecule, which can all be the same or different and capable of reacting with the functional groups of the polymer. Suitable reactive groups in polymers are for example carboxyl groups, which can react for example with hydroxyl groups, amino groups, epoxy groups or aziridine groups or with multivalent metal ions such as for example $Ca^{2+}$, $Al^{3+}$, $Mg^{2+}Mn^{2+}$ and $Zn^{2+}$, hydroxyl groups, which can react for example with carboxyl groups, isocyanate, epoxide, carboxylic anhydride groups, epoxide groups or aldehyde groups, aldehyde or keto groups, which can react with amino groups and hydrazines, N-methylolamino and N-methoylolamido groups, which can react with a further N-methylolamino or N-methoylolamido groups, isocyanate groups, which can be capped, i.e. reversibly blocked with for example phenol, tert-butanol, 1,3-diketones, malonic esters, cyclic amides such as ϵ-caprolactam, nitrites, aldehydes or oximes, or uncapped and which—capped or uncapped—can react for example with amino groups and hydroxyl groups.

The theoretical crosslink density of suitable self-crosslinking binders, expressed in mol of crosslink points per kg of binder which are formed in the event of complete reaction on the polymer which serves as binder, is preferably in the range from 0.1 to 1 mol/kg of binder.

Examples of suitable crosslinkers are diols and polyols such as for example ethylene glycol, propylene glycol, glycerol, diethylene glycol, triethylene glycol, dipropylene glycol, tripropylene glycol, tetraethylene glycol, 1,3-propanediol, 1,4-butanediol, 1,6-hexanediol, secondary or preferably primary diamines such as for example $C_2$-$C_{12}$-alkylenediamines in which up to 5 nonadjacent carbon atoms may be replaced by oxygen, for example hexamethylenediamine, diethylenetriamine, triethylenetetramine, tetraethylenepentamine, N,N-bis(aminopropyl)aminoethane, 3,6-dioxaoctane-1,3-diamine, 3,7-dioxanonane-1,9-diamine, 3,6,9-trioxaundecane-1,11-diamine, also Jeffamines such as for example 4,4'-diamaminodicyclohexylmethane

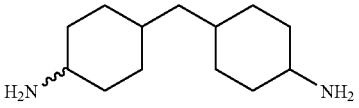

and 4,4'-diamino-3,3'-dimethyldicyclohexylmethane,

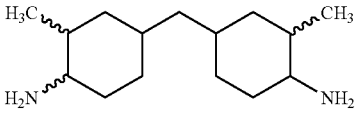

amino alcohols such as for example ethanolamine, 3-hydroxypropylamine, singly and multiply ethoxylated di- and oligoamines, dihydrazides of aliphatic and aromatic dicarboxylic acids such as for example adipic dihydrazide, dialdehydes such as glyoxal, partially or fully O-methylolated melamines, salts of divalent metals, especially magnesium chloride, for example as hydrate ($MgCl_2.6H_2O$), and also compounds which on average (number average) have 2 or more and preferably 3 or more isocyanate groups or blocked isocyanate groups per molecule.

In one embodiment aqueous liquors used in the process of the present invention comprise from 100 to 800 g/l of binder and preferably from 200 to 500 g/l.

One or more adhesion promoters (d) may be added in an embodiment of the present invention.

Very particular preference is given to using hydrophilic organic polymers as adhesion promoters (d).

In one embodiment of the present invention hydrophilic organic polymers used as an adhesion promoter (d) are polymers or copolymers containing the structural elements I.1 to I.4.

I.1

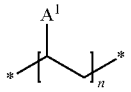

I.2

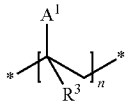

I.3

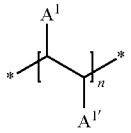

I.4

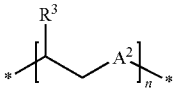

In one embodiment of the present invention, hydrophilic organic polymers or copolymers have a ratio in the range from 3:1 to 1:5 and especially from 3:2 to 1:3 for the sum total of nitrogen atoms and oxygen atoms to carbon atoms.

Another embodiment of the present invention utilizes adhesion promoters (d) comprising hydrophilic organic polymers which contain polar structural elements which are not ionizable at pH values in the range from 3 to 12, examples being polyurethane units, polyethylene glycol units, polyvinylpyrrolidone units, polyvinyl alcohol units, polyvinylformamide units or polysaccharide units.

It will be appreciated that it is also possible to use copolymers containing different structural elements I.1 to I.4.

Examples of suitable hydrophilic polymers and copolymers are those having the following polar groups $A^1$ and $A^{1'}$:

—$SO_3H$, —$SO_3^-X^+$, —$PO_3H_2$, —$PO_3^{2-}2X^+$, —O—$PO_3H_2$, —COOH, —$COOR^1$, —$COO^-X^+$, —C(O)$NR^1R^2$, —C(O)$NR^1R^2$, —OH, —$OCH_3$.

The chain of suitable hydrophilic organic polymers and copolymers may contain for example one or more of the following divalent groups $A^2$:

—O—, —C(O)O—, —O—C(O)O—, —$NR^1$—C(O)$NR^2$—, —C(O)$NR^1$—, —$CH_2CH_2O$—, —C(O)$NR^1$C(O)—, —O—C(O)$NR^1$C(O)—, —O—C(O)$NR^1$C(O)—O—, —C(O)$NR^1$C(O)$NR^2$—, —O—C(O)$NR^1$C(O)$NR^2$—, —O—C(O)$NR^1$C(O)—O—,

X represents Li, Na, K, Rb, Cs or ammonium ions of the formula $N(R^3)_4$;

$R^1$ to $R^2$ are each the same or different and represent H, $C_1$-$C_4$-alkyl selected from methyl, ethyl, n-propyl, isopropyl, n-butyl, isobutyl, sec-butyl and tert-butyl;

n is an integer in the range from 8 to 80 000 and preferably in the range from 10 to 16 000.

$R^3$ is at each instance the same or different and selected from hydrogen;

$C_1$-$C_4$-alkyl selected from methyl, ethyl, n-propyl, isopropyl, n-butyl, isobutyl, sec-butyl and tert-butyl;

—$CH_2$—$CH_2$—OH benzyl or $C_6$-$C_{14}$-aryl, preferably phenyl.

By way of example there may be mentioned the following ammonium ions: $NH_4^+$, $CH_3NH_3^+$, $(CH_3)_2NH_2^+$, $(CH_3)_3NH^+$, $(CH_3)_4N^+$, $C_2H_5NH_3^+$, $H_2N(CH_2CH_2OH)_2^+$, $HN(CH_2CH_2OH)_3^+$, $CH_3NH(CH_2CH_2OH)_2^+$, n-$C_4H_9NH(CH_2CH_2OH)_2^+$.

Very particularly preferred polar groups are those single-bondedly polymer-attached a. 1.1 to a. 1.7

I.1.1

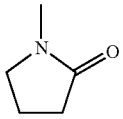

I.1.2

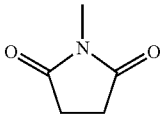

I.1.3

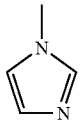

I.1.4

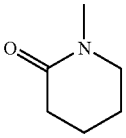

I.1.5

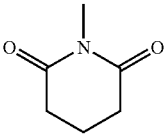

-continued

I.1.6

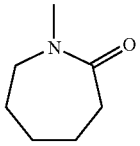

I.1.7

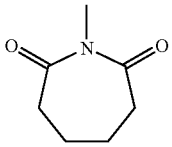

I.1.8

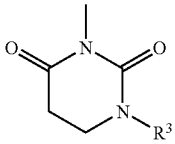

I.1.9

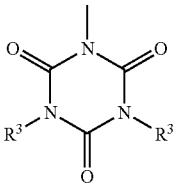

Groups I.1.1 to I.1.9 can be in the polymer or copolymer's main chain or—if for example a branched or crosslinked polymer or copolymer is concerned—in the polymer side chains of hydrophilic organic polymer or copolymer.

The distribution of groups I.1.1 to I.1.9 over the polymer molecule of hydrophilic organic polymer or copolymer can be uniform. i.e. random or alternating, or nonuniform, as is the case for example with block copolymers and especially with graft copolymers.

Polymers and copolymers used in the present invention may also contain the groups I.1.1a and/or I.1.2a I.1.1a

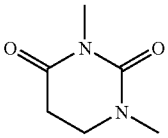

I.1.2a

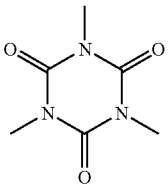

in which case polymers or copolymers used in the present invention preferably form branched or crosslinked structures via these groups.

Groups I.1.1a to I.1.2a can be in the polymer or copolymer's main chain or—if for example a branched or crosslinked polymer or copolymer is concerned—in the polymer side chains of hydrophilic organic polymer or copolymer. The distribution of groups I.1.1a to I.1.2a over the polymer molecule of hydrophilic organic polymer or copolymer can be uniform, i.e., random or alternating, or nonuniform, as is the case for example with block copolymers.

In one embodiment of the present invention the aqueous liquor has added to it from 1 to 150 g/l of adhesion promoter, preferably at least 4 g/l and more preferably at least 5 g/l.

Aqueous liquors used in the process of the present invention may have added to them for the purpose of adjusting the viscosity, one or more thickeners which can be for example of natural or synthetic origin. Suitable synthetic thickeners are poly(meth)acryloyl compounds, polycarboxylic acids, polyethers, polyimines, polyamides and polyurethanes, especially copolymers comprising from 85% to 95% by weight of acrylic acid, from 4% to 14% by weight of acrylamide and about 0.01-1% by weight of the (meth)acrylamide derivative of formula II

II

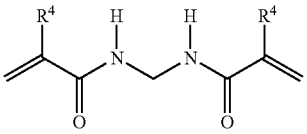

having molecular weights $M_w$ in the range from 100 000 to 200 000 g/mol, in each of which $R^4$ represents methyl or preferably hydrogen. Examples of thickeners of natural origin are agar, carrageen, modified starch and modified cellulose.

The amount of thickener used can be for example in the range from 0% to 10% by weight, based on liquor used in the process of the present invention, preferably from 0.05% to 5% by weight and more preferably from 0.1% to 3% by weight.

Aqueous liquors used in the process of the present invention preferably have a room temperature dynamic viscosity in the range from 10 to 5000 mPa·s, preferably in the range from 20 to 4000 mPa·s and more preferably in the range from 50 to 2000 mPa·s, measured for example using a Brookfield viscometer in accordance with German standard specification DIN 51562 Parts 1 to 4.

In one embodiment of the present invention aqueous liquors used in the process of the present invention may have added to them one or more pigments, for example inorganic or organic pigments, preferably in the form of surfactant-containing pigment preparations.

The present invention further provides surfaces, for example surfaces of substrates, obtainable by the process of the present invention. The surfaces of the present invention are preferably textile surfaces. Surfaces according to the present invention are notable for good cleanability with regard to soil, soil selectable for example from solid and liquid materials. Examples of solid materials are earth, sludge, soot, dust, pollen; examples of liquid materials are urine, oil such as olive oil and coffee, tea, fruit juices, beer and red wine. Soil is easy to remove from surfaces according to the present invention. Surfaces according to the present invention are further observed to possess good durability. Textile surfaces according to the present invention can be washed more than 5 times in conventional washing machines without losing their advantageous properties. Surfaces according to the present invention also possess very good optical properties such as for example a high transparency.

Water on surfaces according to the present invention forms drops very slowly and ideally not at all. The contact angle with water is generally less than 10° and preferably less than 5°; ideally, they are not measurable at all. Wet surfaces according to the present invention are therefore easy to dry. Dry surfaces according to the present invention show little tendency to mist.

The present invention further provides garments having surfaces according to the present invention and especially garments having outer surfaces produced by the process of the present invention.

The present invention further provides diapers having surfaces according to the present invention. They retain urine particularly well.

The invention is illustrated by working examples.

Working Examples

General Preliminaries

The measurements to determine surface energy (corresponding to surface tension) were carried out as described in WO 01/96433 at page 19.

Absorbency was determined on the lines of German standard specification DIN 53924. The riser liquid used was a 0.5% by weight aqueous solution of the substantive dye Luran Turquoise Blue GL. The height of rise was 1 cm in each case and in the case of woven fabrics was in each case determined in the warp direction. A stamp standardized as per German standard specification DIN 53924 was used to apply a mark on a sample of coated or uncoated textile sheetlike structure (fabric), which was at least 8 cm by 4 cm in size. The sample was clamped perpendicularly and the lower end was weighted with a hat-clamp, so that the lower end dipped into the riser liquid. The riser liquid then began to rise in the fabric. As soon as the riser liquid crossed the finish line on the average front the time was taken.

The drop test was carried out as TEGEWA drop test as per *Melliand Textilberichte* 1987, 68, 581-3.

Production of Inventive Surfaces 1.1 Production of Aqueous Liquors 1.1.1 Production of Aqueous Liquor 1

The following were mixed together in a bottle:

601.15 g of distilled water, 200 g of ethanol, (a.1): 60 g of a 10% by weight aqueous dispersion of amorphous silica, particle diameter 5.5 μm (median value, number average), determined by laser diffraction using a Beckman Coulter LS 230; BET surface area in accordance with German standard specification DIN 66131: 750 $m^2/g$, surface energy 150 mN/m, produced by mixing above-identified amorphous silica and water by means of an Ultraturrax;

(b.1): 60 g of a 10% by weight aqueous dispersion of amorphous silica, particle diameter 22 nm (median value, number average), determined by laser diffraction using a Beckman Coulter LS 230, BET surface area in accordance with German standard specification DIN 66131: 140 $m^2/g$, surface energy 150 mN/m, produced by mixing above-identified amorphous silica and water;

(c.1): 18.85 of self-crosslinking binder composed of 17.14 of a 70% by weight aqueous solution of 1,3-dimethylol-4,5-dihydroxyethyleneurea (DMDHEU) and 1.71 of crystalline magnesium chloride ($MgCl_2.6H_2O$)

(d.1): 60 g of a 10% by weight aqueous solution of polyvinylpyrrolidone having $M_w$ of 50 000 g/mol, determined by gel permeation chromatography, and a Fikentscher K value of 30, determined after H. Fikentscher at 25° C. in water and a polyvinylpyrrolidone concentration of 1% by weight.

Aqueous liquor 1 was obtained.

1.1.2 Production of Further Aqueous Liquors 2 to 8

1.1.1 was repeated using the amounts of distilled water, ethanol, (a.1), (b.1), (c.1) and (d.1) as per table 1. Amounts reported for (a.1), (b.1), (c.1) and (d.1) are each based on aqueous dispersions/mixtures as indicated under 1.1.1. The results are summarized in table 1.

TABLE 1

Composition of aqueous liquors 1 to 5

| No. | Distilled water [g] | Ethanol [g] | (a.1) [g] | (b.1) [g] | (c.1) [g] | (d.1) [g} |
|---|---|---|---|---|---|---|
| 1 | 601.15 | 200 | 60 | 60 | 18.85 | 60 |
| 2 | 601.15 | 200 | 84 | 36 | 18.85 | 60 |
| 3 | 601.15 | 200 | 36 | 84 | 18.85 | 60 |
| 4 | 601.15 | 200 | 120 | 0 | 18.85 | 60 |
| 5 | 601.15 | 200 | 0 | 120 | 18.85 | 60 |
| 6 | 620 | 200 | 60 | 60 | — | 60 |
| 7 | 620 | 200 | 36 | 84 | — | 60 |
| 8 | 620 | 200 | — | 120 | — | 60 |

1.1.3 Production of Aqueous Liquor 9

940 g of distilled water, 60 g of a 10% by weight aqueous di-n-octyl sulfosuccinate solution were mixed together.

Aqueous liquor 9 was obtained.

1.2. Coating of Surfaces 1.2.1. Coating of Woven Polyester Fabric

Woven polyester fabric having a basis weight of 220 g/m$^2$ was treated with a liquor as per tables 1 and 2 on a pad-mangle from Mathis (model HVF12085). The application speed was 1 m/min. The squeeze pressure was 10 bar. This resulted in an add-on in the range from 1.8 to 2.7 g/m$^2$. The treated polyester fabric was subsequently dried on a tenter at 120° C. The conclusive heat treatment took 3 min at 150° C. with circulating air. The coated polyester fabric as per table 2 was obtained.

TABLE 2

Inventive coated polyester fabrics 1.2.1 to 1.2.3 and comparative fabrics V1.2.4 to V1.2.5

| Fabric | Coating with liquor No. | Suck test [s/cm] | Sink time [s] |
|---|---|---|---|
| 1.2.1 | 1 | 3.7 | 1.5 |
| 1.2.2 | 2 | 3.2 | 1.6 |
| 1.2.3 | 3 | 2.1 | 1.0 |
| V1.2.4 | 4 | 5.6 | 3.4 |
| V1.2.5 | 5 | 6.2 | 3.4 |
| Untreated polyester fabric (starting material) | — | >90 | >60 |

1.2.2 Coating of Polypropylene Nonwoven

Polypropylene nonwoven having a basis weight of 10 g/m$^2$ was treated with a liquor as per tables 1 and 3 on a pad-mangle from Mathis (model HVF12085). The application speed was 1 m/min. The squeeze pressure was 10 bar. This resulted in an add-on in the range from 0.08 to 0.12 g/m$^2$. The treated polypropylene nonwoven was subsequently dried on a tenter at 80° C. to obtain coated polypropylene nonwoven as per table 3.

TABLE 3

Inventive coated polypropylene nonwovens 1.2.6 to 1.2.8 and comparative nonwoven V1.2.9

| Fabric | Liquor | Edana RUN-OFF test [ml] 1st splash | 2nd splash | 3rd splash | 4th splash | Surface tension [mN/m] |
|---|---|---|---|---|---|---|
| 1.2.6 | 6 | 1.886 | 1.486 | 0.837 | 1.977 | 68.55 |
| 1.2.7 | 7 | 3.589 | 1.807 | 0.139 | 0.046 | 68.80 |
| 1.2.8 | 8 | 7.653 | 3.868 | 2.566 | 6.368 | 68.60 |
| V1.2.9 | 9 | 14.097 | 23.42 | 24.233 | n.d. | 50.27 |

n.d.: not determined

Tests on Inventive Coated Surfaces and Comparative Surfaces

Surfaces coated according to the present invention and comparative surfaces were tested for their performance characteristics. The data are given in tables 2 and 3 respectively.

Polypropylene nonwovens were tested by the Edana RUN-OFF test (152.0-99), a test recommended by EDANA (European Disposables and Nonwovens Association).

Coated nonwoven was fixed on an inclined plane (angle of inclination: 25°). Absorbent cardboard was fixed underneath the nonwoven to take up liquid which has passed through the nonwoven. 25 g of simulated urine (aqueous NaCl solution, 0.9% by weight) were then passed in 4× (1st splash, 2nd splash, 3rd splash, 4th splash) over the nonwoven, the cardboard being changed between every two insults. The amount of water which ran off over the nonwoven was collected at the foot of the inclined plane and its volume was determined in each case. The less simulated urine ran over the nonwoven, the better the hydrophilicity of the nonwoven.

The surface tension relates in each case to collected simulated urine, The higher the surface tension, the better the suitability of propylene nonwovens as or for producing diapers.

The results are listed in table 3.

We claim:

1. A process for producing a structured surface possessing a high level of hydrophilicity, wherein said process comprises:

coating a surface with a mixture to produce the structured surface, wherein the mixture comprises:

(a) particles having a number average particle diameter of from 0.1 μm to 10 μm; and (b) particles comprising an inorganic material and having a number average particle diameter of from 5 μm to 0.5 μm and a 20° C. surface energy of greater than or equal to 80 mN/m, wherein the mixture exhibits a bimodal particle diameter distribution of particles (a) and particles (b), and wherein the surface is a textile surface.

2. The process according to claim 1, wherein particles (a) have a number average particle diameter of from 0.2 μm to 5 μm.

3. The process according to claim 1, wherein particles (a) are composed of a material selected from the group consisting of a hydrophobic polymer, a hydrophobic inorganic material, a hydrophilic polymer, and a hydrophilic inorganic material.

4. The process according to claim 3, wherein particles (a) are composed of one or more hydrophobic polymers.

5. The process according to claim 1, wherein particles (a) have a 20° C. surface energy of 10-70 mN/m.

6. The process according to claim 1, wherein particles (b) have a number average particle diameter of from 10 nm to 400 nm.

7. The process according to claim 1, wherein particles (b) further comprise a hydrophilic polymer.

8. The process according to claim 1, wherein particles (b) are composed of one or more hydrophilic inorganic materials.

9. The process according to claim 1, wherein particles (a) and particles (b) are identical in composition with the exception of having different number average particle diameters.

10. The process according to claim 1, wherein particles (a) and particles (b) are different in composition and have different number average particle diameters.

11. The process according to claim 1, wherein the mixture further comprises an aqueous liquor.

12. The process according to claim 11, wherein at least one aqueous liquor comprises at least one emulsifier.

13. The process according to claim 1, wherein the mixture further comprises at least one binder.

14. The process according to claim 1, wherein the mixture further comprises at least one adhesion promoter.

15. The process according to claim 1, wherein the mixture is in the form of an aqueous dispersion.

16. The process according to claim 1, wherein said process further comprises:

providing the surface with a bonding layer prior to said coating.

17. The structured surface produced by the process according to claim 1.

18. The structured surface according to claim 17, wherein the structured surface is a structured textile surface.

19. A garment comprising the structured surface according to claim 17.

* * * * *